US006742628B2

(12) United States Patent
Bauer

(10) Patent No.: US 6,742,628 B2
(45) Date of Patent: Jun. 1, 2004

(54) ROPE ELEVATOR

(75) Inventor: Zeno Bauer, Isen (DE)

(73) Assignee: Inventio AG, Hergiswil NW (CH)

( * ) Notice: Subject to any disclaimer, the term of this patent is extended or adjusted under 35 U.S.C. 154(b) by 77 days.

(21) Appl. No.: 10/119,551

(22) Filed: Apr. 10, 2002

(65) Prior Publication Data

US 2002/0185338 A1 Dec. 12, 2002

Related U.S. Application Data

(63) Continuation of application No. PCT/CH00/00543, filed on Oct. 5, 2000.

(30) Foreign Application Priority Data

Oct. 11, 1999 (EP) ..... 99810923

(51) Int. Cl.[7] ..... B66B 11/08; B66B 7/06
(52) U.S. Cl. ..... 187/254; 187/266
(58) Field of Search ..... 187/250, 251, 187/254, 256, 266, 411

(56) References Cited

U.S. PATENT DOCUMENTS 6,302,239 B1 * 10/2001 Honda ..... 187/254
6,397,974 B1 * 6/2002 Adifon et al. ..... 187/254
6,598,707 B2 * 7/2003 Nakagaki et al. ..... 187/266

FOREIGN PATENT DOCUMENTS

| | | |
|---|---|---|
| DE | 197 12 646 | 10/1998 |
| DE | 197 52 232 | 5/1999 |
| EP | 0 841 283 | 5/1998 |
| EP | 0 905 081 | 3/1999 |
| FR | 2 773 363 | 7/1999 |
| WO | WO 99/33742 | 7/1999 |

* cited by examiner

*Primary Examiner*—Eileen D. Lillis
*Assistant Examiner*—Thuy V. Tran
(74) *Attorney, Agent, or Firm*—MacMillan, Sobanski & Todd, LLC

(57) ABSTRACT

A rope elevator has a car and a counterweight hanging on suspension ropes and moving in opposite directions along guiderails in a hoistway. The elevator is driven by a drive unit with a traction sheave that is placed above the travel-path of the counterweight so that the upper part of the car can reach a position in the hoistway above the drive unit. The suspension ropes run from a first hitch-point in the vicinity of the counterweight-side side-wall and around one or two pulleys of the counterweight, around the traction sheave, down and horizontally/diagonally across two pulleys underneath the car, and up to a second hitch-point on the car-side side-wall of the hoistway. The drive unit is fastened by a supporting construction exclusively to the two counterweight guiderails and to the car guiderail on the counterweight side of the car.

20 Claims, 3 Drawing Sheets

ROPE ELEVATOR

This is a continuation of PCT/CH00/00543, filed Oct. 5, 2000.

DESCRIPTION

The present invention relates to a rope elevator which has a car and a counterweight which hang on suspension ropes and move in opposite directions along guiderails in an elevator hoistway, the car guide-plane formed by two car guiderails running parallel to the car-front and approximately through the center-of-gravity of the car, the elevator being driven by a drive unit with traction sheave which is so placed in the hoistway overhead above the travel-path of the counterweight that the upper part of the car can reach a position in the hoistway above this drive unit, and the suspension ropes running down from a hitch-point situated in the hoistway overhead in the vicinity of the counterweight-side side-wall of the hoistway and around one or two pulleys of the counterweight, then up and around the traction sheave of the drive unit, then down again and horizontally/diagonally across under two pulleys underneath the car, and finally up again to a second hitch-point on the car-side side-wall of the hoistway.

From DE 197 12 646 Al a machine-room-less rope elevator is known whose drive unit with traction sheave is arranged on a concrete plinth projecting into the elevator hoistway. However, this solution has certain disadvantages. The elevator hoistway and/or the landing floor have to be designed with strength in the vicinity of the proposed concrete plinth for the maximum stresses arising on the drive unit due to operation of the elevator. The necessary construction by builders of such a concrete plinth in an otherwise simple, cubical space causes considerable extra outlay. If the plinth is not executed as drawn, problems and delays in the installation of the elevator can occur.

FR 2 773 363-A3 discloses the machine-room-less arrangement of an elevator drive unit. This is mounted on a support which is fastened at one end to two counterweight guiderails and a car guiderail and at the other end via a console to a wall of the normally concreted elevator hoistway. Such a solution has significant disadvantages. The hoistway wall has to absorb an undefined proportion of the vertical forces acting on the drive unit. Furthermore, strain occurs in the support fastened to the hoistway wall and guiderails as a result of building shrinkage of the (concrete) hoistway wall and as a result of differing thermal expansion of the guiderails and hoistway wall (because of these problems the guiderails are fastened to the hoistway walls in longitudinally movable manner).

The task of the present invention is to propose a solution by means of which the advantageous arrangement of the drive unit can be realized while avoiding the disadvantages stated.

This task is solved according to the invention by the distinguishing characteristics of Patent claim 1. With the proposed fastening of the supporting construction of the drive unit on three guiderails, the operating forces acting on the drive, and the force of its weight, are essentially transmitted via these guiderails directly into the foundation of the elevator hoistway, which allows the required strength of the hoistway wall to be substantially reduced.

Advantageous embodiments and further developments of the invention are stated in the subclaims.

According to a preferred embodiment of the invention, placing the drive unit with its traction sheave, and usually also with the counterweight pulley(s), diagonally results in the center-of-gravity of the counterweight, which is located below the center of the counterweight pulley(s), coming to lie closer to the hoistway wall than is possible with an arrangement of the traction sheave and pulley(s) parallel to the counterweight, because of the distance of the traction sheave from the hoistway wall given by the dimensions of the drive unit. The space-saving arrangement of the counterweight achieved in this manner allows the use of a car with greatest-possible width.

A further preferred embodiment of the invention is achieved by the section of suspension rope running vertically from the traction sheave to the first car pulley being arranged in the free area of the hoistway between hoistway wall and car side-wall, which is not occupied by the travel-path of the counterweight and the guiderail fastening brackets surrounding it. Different from the arrangement of suspension ropes given as state of the art, where the stated section of suspension rope is guided between the guiderail fastening brackets surrounding the counterweight and the car side-wall, the preferred suspension rope arrangement proposed here causes no loss of installation space for the car. This is especially advantageous if, in the case of large building heights, substantial vibrations of the stated section of suspension rope are to be expected, and therefore relatively large free spaces needed around it.

Included in the advantageous embodiments of the invention is also that the first hitch-point of the suspension ropes is provided on the supporting construction of the drive unit. This saves time and costs for mounting a hitch-point support on the hoistway wall during installation of the elevator, and avoids a possible source of error.

In a further preferred embodiment of the rope elevator according to the invention, the drive unit is executed as a worm gear, the drive motor being arranged vertically in order to reduce the space required.

Also included in the preferred embodiments is that the counterweight is arranged at the side of, and adjacent to, the car, and with its guide-plane formed of two counterweight guiderails parallel to the side-wall of the car. Firstly, by this means an optimal utilization of the hoistway space is achieved, because free space at the side of the car is required for the opened access doors. Secondly, the drive unit can, if necessary, be made observable and accessible by means of inspection windows and/or service doors in the usually freely-available front of the hoistway.

An exemplary embodiment of the invention is shown in FIGS. 1 to 4 and explained in more detail in the following description.

Figure 1:
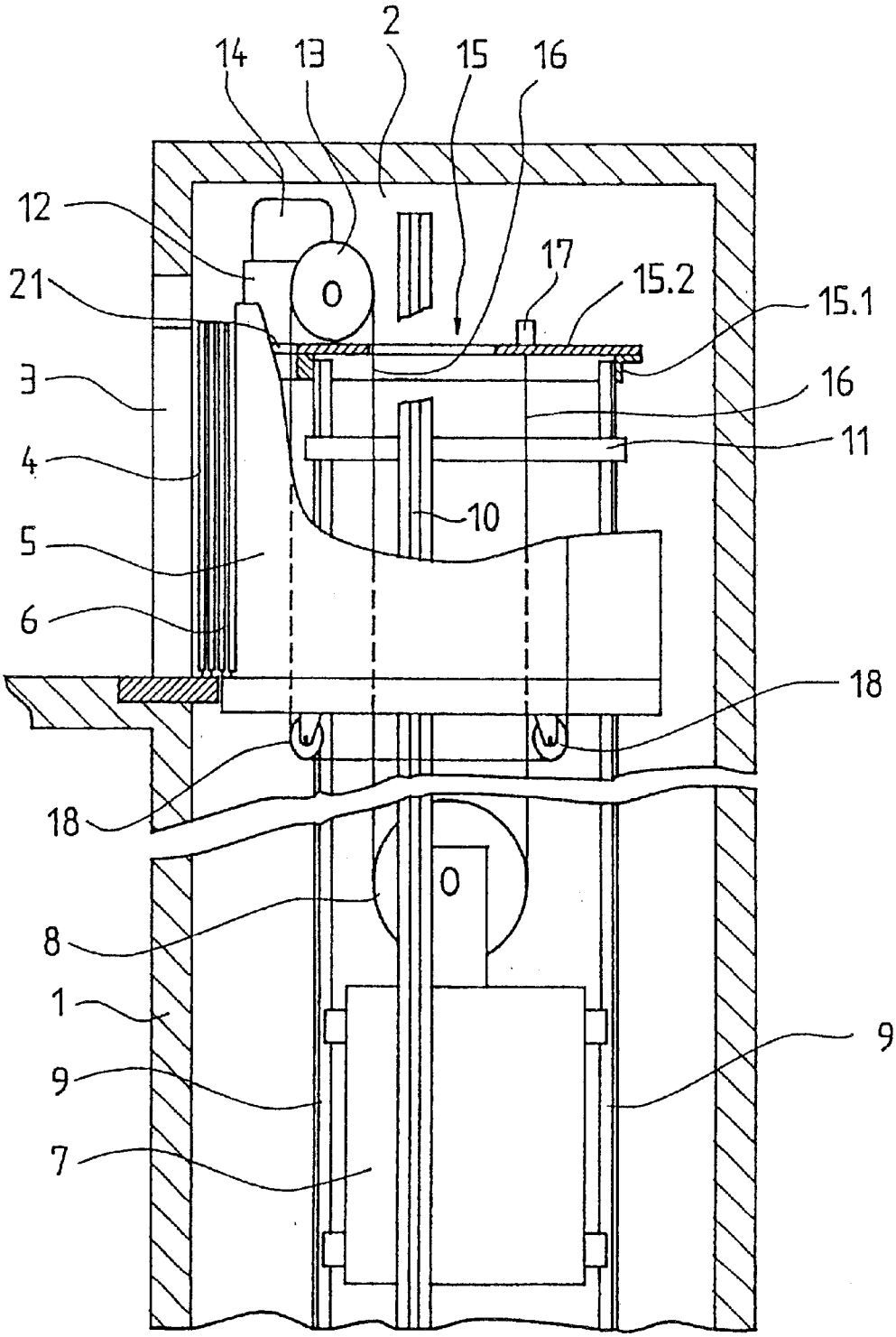
FIG. 1 is a side view of the rope elevator installation according to the present invention installed in an elevator hoistway shown in cross-section.

Visible in FIG. 1 are an elevator hoistway 1 with the hoistway overhead 2, and a first hoistway access opening 3 with a landing hoistway door 4. 5 indicates an elevator car viewed from the side, whose upper part is shown cut away to permit a better view of the drive arrangement situated behind it, and which has a car door 6 shown here diagrammatically. Visible in the lower part of this drawing are a counterweight 7, with an associated counterweight pulley 8, and two counterweight guiderails 9. Also shown is the car guiderail 10 on the counterweight-side of the car. The counterweight guiderails 9, and the car guiderail 10 on the counterweight-side, are fastened to the counterweight-side side-wall of the hoistway with a large number of guiderail fastening brackets 11 distributed over the entire height of the hoistway. Shown in the area of the hoistway overhead 2 is a drive unit 12 with traction sheave 13 and electric motor 14, mounted on a supporting construction 15, which consists of a frame 15.1 made of sections and a mounting plate 15.2, and which itself is fastened to two counterweight guiderails 9 and the car guiderail 10 on the counterweight-side of the car. Also visible here is the path of the suspension ropes 16, in each case only one of several ropes arranged in parallel being illustrated. The starting point is a first rope hitch-point 17 integrated in the supporting construction 15 of the drive unit 12 in the vicinity of the counterweight-side hoistway wall. From here the suspension ropes first run down and around the counterweight pulley 8, then up and around the traction sheave 12 of the drive unit 11, then down again and horizontally/diagonally across under two car pulleys 18 underneath the car 5, and finally up again to a second hitch-point 19 on the car-side side-wall 20 of the hoistway (19, 20 are not visible in this view).

In the vicinity of the section of suspension rope running down from the traction sheave 13 to the car pulley 18, the mounting plate 15.1 of the supporting construction 15 has a cutout 21 so that this section of the suspension rope can be installed at a sufficient distance from the side-wall of the car without the distance between the car and the counterweight installation thereby having to be increased.

Figure 2:
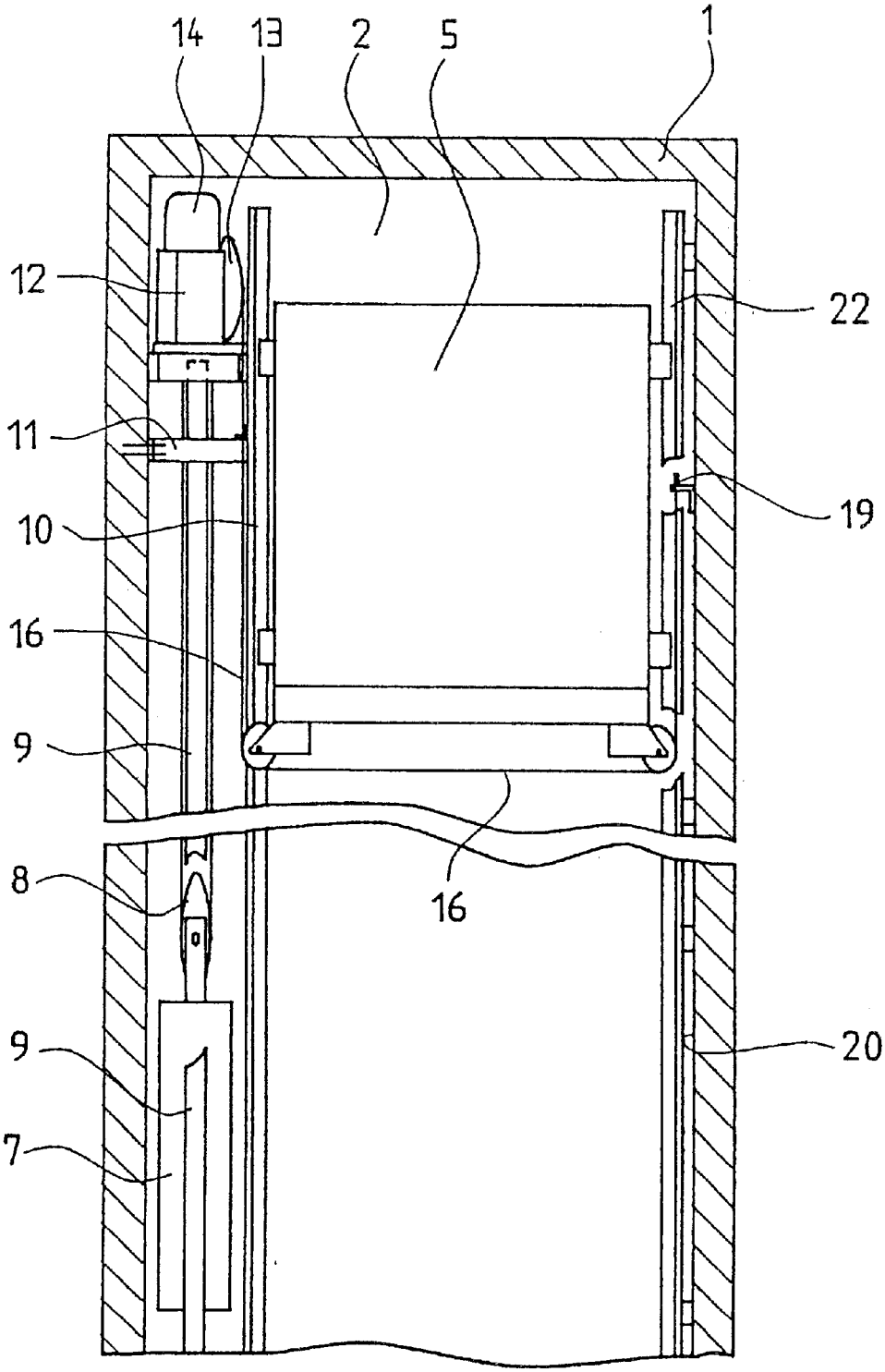
FIG. 2 is a front view of the elevator installation shown in FIG. 1.

FIG. 2 shows a vertical cross-section through the elevator hoistway 1 and the elevator car 5 viewed from the entrance side, the plane of the section lying between the car door and the car-front. Visible here—viewed from the car-front —are the elevator car 5, the counterweight 7 from its narrow side with the associated counterweight pulley 8, the counterweight guiderails 9, the car guiderails 10 on the counterweight side, the guiderail fastening brackets 11, the drive unit 12 aligned diagonal to the hoistway wall, with its traction sheave 13 and its electric motor 14 standing vertically. Viewed in this direction it can be seen how the supporting construction 15 of the drive unit 12 is fastened to the two counterweight guiderails 9 and to the car guiderails 10 on the counterweight side.

Also visible is the path of the suspension ropes 16 and the underslinging of the car. Also shown here are the second hitch-point 19 fastened to the hoistway wall 20 on the car-side, as well as the right-hand car guiderail 22 fastened to this wall.

Figure 3:
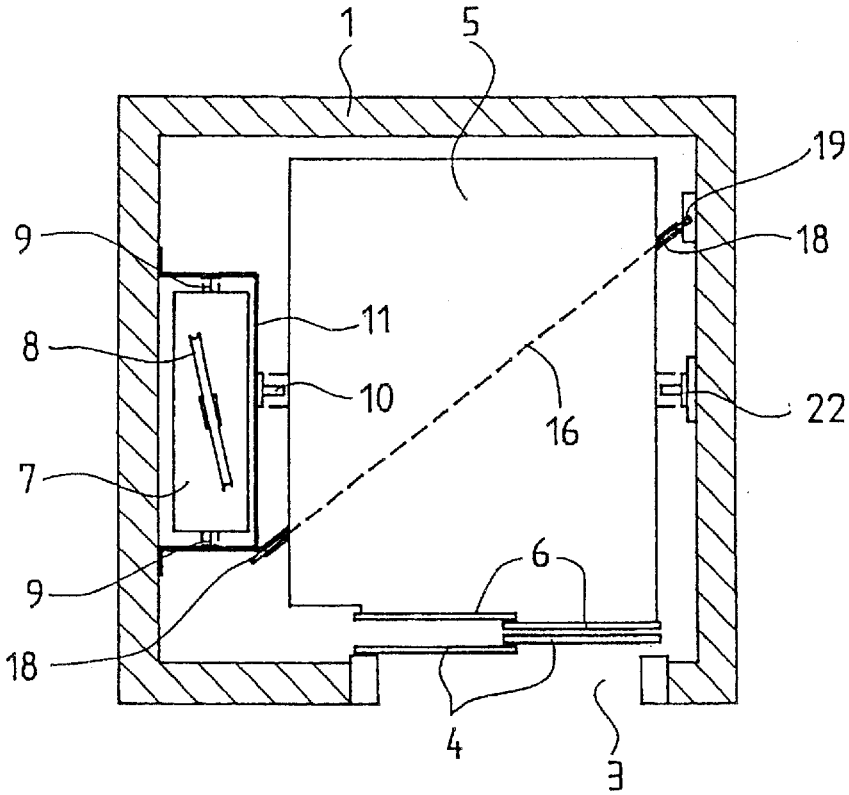
FIG. 3 is a top plan view of the elevator installation shown in FIGS. 1 and 2.

FIG. 3 shows a horizontal cross-section through the elevator car 5 and the counterweight arrangement. The drive unit and its supporting construction lie above this cross-section and are not visible. Shown here diagrammatically is the car entrance with one hoistway access opening 3, a landing hoistway door 4, and a car door 6. Also visible are the counterweight 7 and the associated counterweight pulley 8. Visible arranged around the counterweight is one of the guiderail fastening brackets 11, which are distributed over the hoistway height and bolted to the hoistway wall, and with which the two counterweight guiderails 9 and the car guiderails 10 on the counterweight-side are fastened. These three guiderails reach down to the floor of the hoistway, and fastened to them in the area of the hoistway overhead is the supporting construction for the drive unit (not visible here). Also visible on the right-hand side of the illustration is the right-hand car guiderail 22 fastened to the car-side hoistway wall 20.

Figure 4:
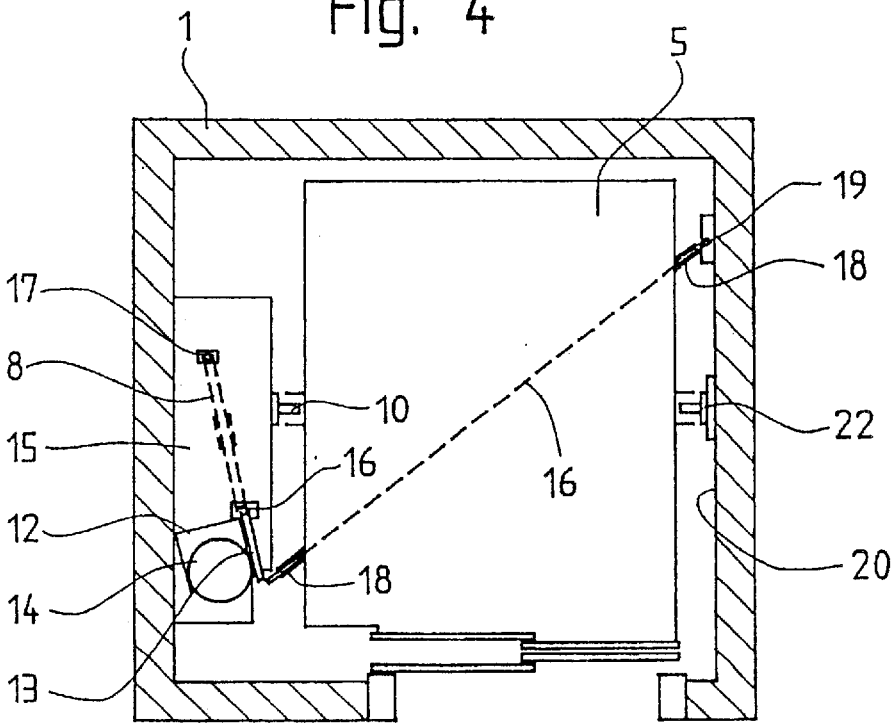
FIG. 4 is a bottom plan view of the elevator installation shown in FIGS. 1 and 2.

FIG. 4 shows a plan view of the elevator hoistway 1 (without hoistway ceiling). Visible at left fastened to two counterweight guiderails and the car guiderail 10 on the counterweight-side is the supporting construction 15 for the drive unit 12. On this, the latter is arranged with its traction sheave 13 diagonal to the hoistway wall so as, together with a diagonal placement of the counterweight pulley 8, to result in a position of the counterweight 8, which hangs with its center-of-gravity below this counterweight pulley, which is nearer to the hoistway wall than would be possible with the traction sheave and counterweight pulley aligned parallel to the hoistway wall, due to the dimensions of the drive unit 12. This illustration also shows that the section of suspension rope running vertically from the traction sheave 13 to the first car pulley 18 is arranged in the area of the hoistway between the hoistway wall and the side-wall of the car which is not occupied by the travel-path of the counterweight and the guiderail fastening brackets surrounding it, which allows optimal utilization of the hoistway space by a car of maximum width. The drive unit shown here in the form of a worm gear illustrates well that the vertical arrangement of the electric motor 14 also brings substantial advantages in relation to the stated space utilization. Also easily visible in this illustration is the arrangement of the car pulleys 18 fastened underneath the elevator car, the two hitch-points 17 and 19, and the suspension ropes 16. These suspension ropes extend from the first hitch-point 17 fastened onto the supporting construction 15 to, and 180° around, the counterweight pulley lying below it, then to, and 180° around, the traction sheave 13 above, then down, and then horizontally/diagonally across under two car pulleys 18 underneath the car 5, and finally up again to a second hitch-point 19 on the car-side side-wall 20 of the hoistway. Such an arrangement of suspension ropes does not generate a tilting moment, needing to be compensated by the guide system, either with an empty or with a symmetrically loaded car.

In installations with especially wide counterweights, the counterweight pulley is replaced by two pulleys arranged in line one behind the other, which fulfil the same function as one pulley with a large diameter.

What is claimed is:

1. An elevator having a car and a counterweight hanging on at least one suspension rope and being movable in opposite directions in an elevator hoistway, a travel path of the counterweight being between a first side of the car and a first side-wall of the hoistway, the elevator being driven by a drive unit with a traction sheave placed in a hoistway overhead above the travel-path of the counterweight such that an upper part of the car can reach a position in the hoistway above the drive unit, and the at least one suspension rope running down from a first hitch-point situated in the hoistway overhead in the vicinity of the first side-wall of the hoistway and around at least one pulley on the counterweight, then up and around the traction sheave of the drive unit, then down again and horizontally across two pulleys mounted underneath the car, and finally up again to a second hitch-point on a second side-wall of the hoistway adjacent a second side of the car opposite the first side of the car, the elevator further comprising:

a pair of car guiderails mounted in the hoistway and defining a car guide-plane extending generally parallel to a front wall of the car and approximately through a center-of-gravity of the car;

a pair of counterweight guiderails mounted in the hoistway between the first side of the car and the first side-wall of the hoistway; and a supporting construction mounting the drive unit and fastened to said counterweight guiderails and to one of said car guiderails, said first hitch-point being on said supporting construction.

2. The elevator according to claim 1 wherein a section of the at least one suspension rope running vertically from the traction sheave to a first one of the pulleys mounted underneath the car is arranged in a free area of the hoistway between the second side-wall of the hoistway and the second side of the car.

3. The elevator according to claim 1 wherein the first hitch-point is located on the supporting construction.

4. The elevator according to claim 1 wherein the drive unit is a worm gear with a drive motor which stands essentially vertically.

5. The elevator according to claim 1 wherein said counterweight guiderails define a counterweight guide-plane extending generally parallel to the first side of the car.

6. The elevator according to claim 1 wherein the two pulleys mounted underneath the car are arranged to rotate in a plane extending diagonal to a plane of the first side-wall of the hoistway.

7. The elevator according to claim 1 wherein the traction sheave and the pulley on said counterweight are arranged to rotate in a plane extending diagonal to a plane of the first side-wall of the hoistway.

8. An elevator having a car and a counterweight hanging on at least one suspension rope and being movable in opposite directions in an elevator hoistway, a travel path of the counterweight being between a first side of the car and a first side-wall of the hoistway, the elevator being driven by a drive unit with a traction sheave placed in a hoistway overhead above the travel-path of the counterweight such that an upper part of the car can reach a position in the hoistway above the drive unit, and the at least one suspension rope running down from a first hitch-point situated in the hoistway overhead in the vicinity of the first side-wall of the hoistway and around at least one pulley on the counterweight, then up and around the traction sheave of the drive unit, then down again and horizontally across two pulleys mounted underneath the car, and finally up again to a second hitch-point on a second side-wall of the hoistway adjacent a second side of the car opposite the first side of the car, the elevator further comprising:

at least two car guiderails mounted in the hoistway and defining a car guide-plane extending generally parallel to a front wall of the car and approximately through a center-of-gravity of the car;

at least two counterweight guiderails mounted in the hoistway between the first side of the car and the first side-wall of the hoistway; and a supporting construction mounting the drive unit and fastened to said at least two counterweight guiderails and to one of said at least two car guiderails.

9. The elevator according to claim 8 wherein a section of the at least one suspension rope running vertically from the traction sheave to a first one of the pulleys mounted underneath the car is arranged in a free area of the hoistway between the second side-wall of the hoistway and the second side of the car.

10. The elevator according to claim 8 wherein the first hitch-point is located on said supporting construction.

11. The elevator according to claim 8 wherein the drive unit is a worm gear with a drive motor which stands essentially vertically.

12. The elevator according to claim 8 wherein the at least two counterweight guiderails define a counterweight guide-plane extending generally parallel to the first side of the car.

13. The elevator according to claim 8 wherein at least one of the traction sheave of the drive unit and the at least one pulley on the counterweight is arranged to rotate in a plane extending diagonal to a plane of the first side-wall of the hoistway whereby the counterweight, which is arranged with a center-of-gravity below a center of the at least one pulley on the counterweight, is positioned nearer to the adjacent first side-wall of the hoistway than would be possible with the traction sheave and the at least one pulley on the counterweight being aligned parallel to the first side-wall of the hoistway due to the dimensions of the drive unit.

14. An elevator installation comprising:

at least one suspension rope;

a car attached to said at least one suspension rope;

a counterweight attached to said at least one suspension rope, said car and said counterweight movable in opposite directions in an elevator hoistway, a travel path of the counterweight being between a first side of the car and a first side-wall of the hoistway;

a drive unit with a traction sheave placed in a hoistway overhead above the travel-path of the counterweight such that an upper part of the car can reach a position in the hoistway above the drive unit, said at least one suspension rope running down from a first hitch-point situated in the hoistway overhead in the vicinity of the first side-wall of the hoistway and around a pulley on said counterweight, then up and around said traction sheave, then down again and horizontally across two pulleys mounted underneath said car, and finally up again to a second hitch-point on a second side-wall of the hoistway adjacent a second side of said car opposite said first side of the car;

a pair of car guiderails mounted in the hoistway and defining a car guide-plane extending generally parallel to a front wall of said car and approximately through a center-of-gravity of said car;

a pair of counterweight guiderails mounted in the hoistway between said first side of said car and the first side-wall of the hoistway; and a supporting construction mounting said drive unit and fastened to said counterweight guiderails and to one of said car guiderails.

15. The elevator installation according to claim 14 wherein a section of said at least one suspension rope running vertically from said traction sheave to a first one of said pulleys mounted underneath said car is arranged in a free area of the hoistway between the second side-wall of the hoistway and said second side of said car.

16. The elevator installation according to claim 14 wherein the first hitch-point is located on said supporting construction.

17. The elevator installation according to claim 14 wherein said drive unit is a worm gear with a drive motor which stands essentially vertically.

18. The elevator installation according to claim 14 wherein said counterweight guiderails define a counterweight guide-plane extending generally parallel to said first side of said car.

19. The elevator installation according to claim 14 wherein said two pulleys mounted underneath said car are arranged to rotate in a plane extending diagonal to a plane of the first side-wall of the hoistway.

20. The elevator installation according to claim 14 wherein said traction sheave and said pulley on said counterweight are arranged to rotate in a plane extending diagonal to a plane of the first side-wall of the hoistway whereby said counterweight, which is arranged with a center-of-gravity below a center of said pulley on said counterweight, is positioned nearer to the adjacent first side-wall of the hoistway than would be possible with said traction sheave and said pulley on said counterweight being aligned parallel to the first side-wall of the hoistway due to the dimensions of said drive unit.

* * * * *